United States Patent [19]

Wilson et al.

[11] Patent Number: 4,961,336

[45] Date of Patent: Oct. 9, 1990

[54] MANIPULATOR FOR METAL INGOTS

[75] Inventors: Geoffrey Wilson; Paul E. Lister, both of Sheffield, England

[73] Assignee: Davy McKee (Sheffield) Limited, Sheffield, England

[21] Appl. No.: 269,739

[22] PCT Filed: Mar. 2, 1988

[86] PCT No.: PCT/GB88/00152

§ 371 Date: Nov. 2, 1988

§ 102(e) Date: Nov. 2, 1988

[87] PCT Pub. No.: WO88/06498

PCT Pub. Date: Sep. 7, 1988

[30] Foreign Application Priority Data

Mar. 3, 1987 [GB] United Kingdom ..... 8704930

[51] Int. Cl.[5] ..... B21D 43/10; B21J 13/10

[52] U.S. Cl. ..... 72/420; 414/738; 414/621

[58] Field of Search ..... 72/420, 422; 414/753, 414/744 A, 621, 620, 738, 739

[56] References Cited

U.S. PATENT DOCUMENTS

| | | | |
|---|---|---|---|
| 2,720,800 | 10/1955 | Taylor | 72/420 |
| 2,758,734 | 8/1956 | Westling | 72/420 |
| 3,476,276 | 11/1969 | Stubbs et al. | 414/620 |
| 3,498,490 | 3/1970 | Schussler et al. | 414/620 |
| 3,631,996 | 1/1972 | Bonesteel et al. | 414/739 |
| 4,815,311 | 3/1989 | Schubert | 72/422 |

FOREIGN PATENT DOCUMENTS

| | | | |
|---|---|---|---|
| 1252039 | 10/1967 | Fed. Rep. of Germany | 72/422 |
| 564782 | 7/1977 | U.S.S.R. | 72/422 |
| 682317 | 8/1979 | U.S.S.R. | 72/420 |
| 812412 | 3/1981 | U.S.S.R. | 72/420 |
| 893385 | 1/1982 | U.S.S.R. | 72/422 |

*Primary Examiner*—Robert L. Spruill

*Attorney, Agent, or Firm*—Lee, Mann, Smith, McWilliams & Sweeney

[57] ABSTRACT

A manipulator for manipulating metal ingots comprises a wheeled carriage with a peel assembly supported on it so that the peel assembly can move relative to the carriage. The peel assembly is supported adjacent one end of the carriage by at least one piston-cylinder device and a plurality of elongate links are pivotally coupled to the peel assembly and to a rigid support means on the carriage away from the end.

7 Claims, 7 Drawing Sheets

MANIPULATOR FOR METAL INGOTS

This invention relates to manipulators for manipulating metal ingots, particularly during forging.

Such manipulators are well known and consist essentially of a peel assembly mounted on a wheeled carriage. In use, the ingot is gripped, in cantilever fashion, by the jaws of the peel assembly and the peel and ingot can be displaced by displacing the wheeled carriage, usually along a set of rails. In addition, movement of the ingot relative to the wheeled carriage in a number of different directions can be brought about by displacing the peel assembly relative to the carriage.

According to the present invention, a manipulator for a metal ingot comprises a peel assembly and a wheeled carriage; said peel assembly comprising an elongate shaft having at least two cooperating jaws at one end thereof, the shaft being mounted for rotation about its longitudinal axis in a housing structure; said structure being supported on the wheeled carriage adjacent one end thereof and the carriage having a rigid support means spaced from said end; and a plurality of elongate links pivotally secured at their ends to the support means and to the housing structure, respectively.

Conveniently, the housing structure is supported on the wheeled carriage by one or more piston-cylinder devices, with one part of the or each device engaging the housing and the other part of the or each device engaging the wheeled carriage such that the housing structure can be raised and lowered by operation of the or each piston-cylinder device.

In a preferred arrangement, there are two piston-cylinder devices, each having its cylinder connected to the housing and the outer end of its piston engaging the wheeled carriage; and the outer end of each piston is of part-spherical form and engages with a corresponding part-spherical surface on the carriage.

The part-spherical surfaces are conveniently mounted on a part of the carriage which is displaceable in the direction normal to the direction of movement of the carriage and, in this way, by displacing said part of the carriage, the housing is moved towards and away from the sides of the carriage in the direction normal to the direction of movement of the carriage thereby providing a degree of side shift for the peel assembly.

In a preferred arrangement, there are three links pivotally connected to the rigid support means and to the housing structure of the peel assembly. In a convenient arrangement, a pair of said links are positioned at the same level below the axis of the peel and symmetrical with the vertical axis containing the axis of the peel and the third link is located in the vertical plane containing the axis of the peel but above the longitudinal axis of the peel.

At least one of the two lower links is conveniently connected either directly or indirectly to a piston-cylinder device to enable the link to be moved in the direction of its length.

In order that the invention may be more readily understood, it will now be described, by way of example only, with reference to the accompanying drawings, in which.

Figure 1:
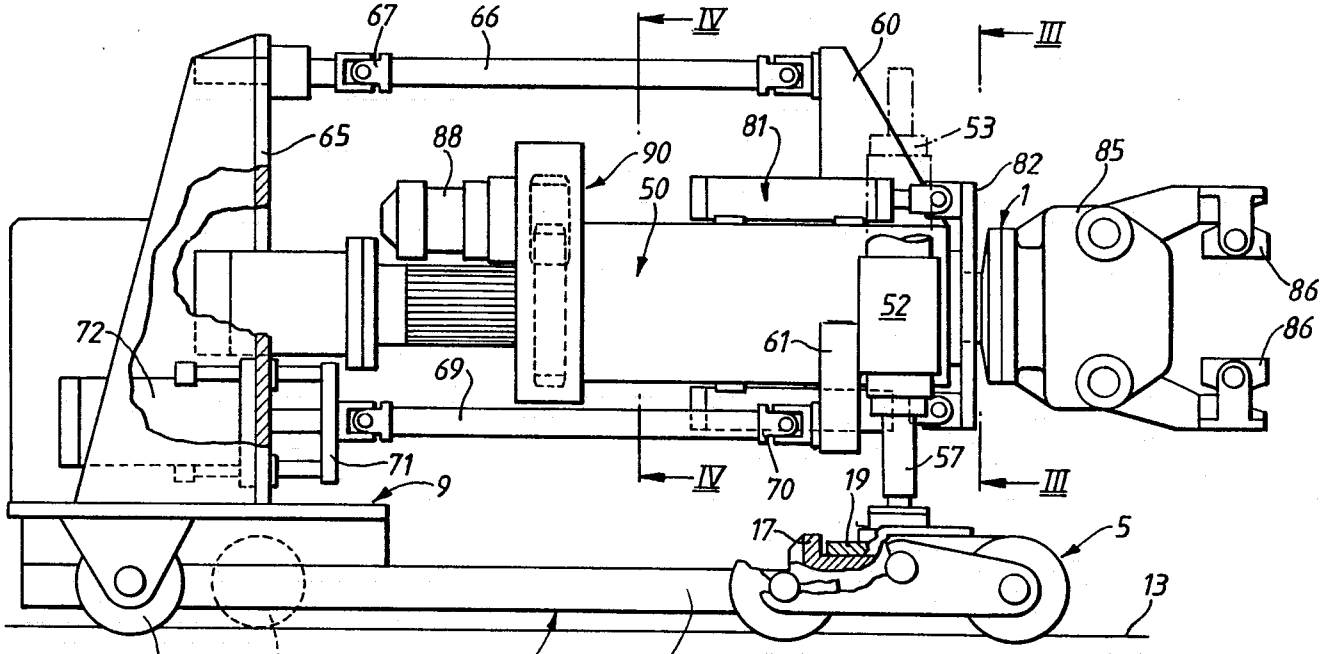
FIG. 1 is a side elevation, with parts cut away, of a manipulator in accordance with one embodiment of the present invention.

Referrring to FIGS. 1 to 9, a manipulator for gripping and manipulating metal ingots comprises a peel assembly 1 mounted on a wheeled carriage 3. The wheeled carriage comprises a front structure mounted on two-wheel bogies 7 and a rear structure 9 mounted on single wheels 11. The front and rear structures are connected by longitudinally extending side beams 12. The wheels are arranged to be supported on a pair of rails 13 and a drive motor (not shown) is mounted beneath the carriage and has a pinion 15 which engages with a rack or chain in order to propel the carriage along the rails 13.

Extending across the width of the front structure there is a guide 17 which permits a slide plate 19 to be displaced therealong. The slide plate 19 has a pair of shoes 21 which provide a concave part-spherical surface 22. A downwardly depending lug 23 (FIG. 5) is positioned centrally of the plate 19 and it projects through a slot in the guide 17. A pair of piston-cyliner devices 25 are mounted in opposed relation on the underside of the guide 17 and the pistons are pivotally connected to the lug 23. By actuating one or other of the piston-cylinder devices, the plate 19 can be caused to reciprocate relative to the guide 17 in the direction at right angles to the direction of movement of the carriage.

Figure 3:
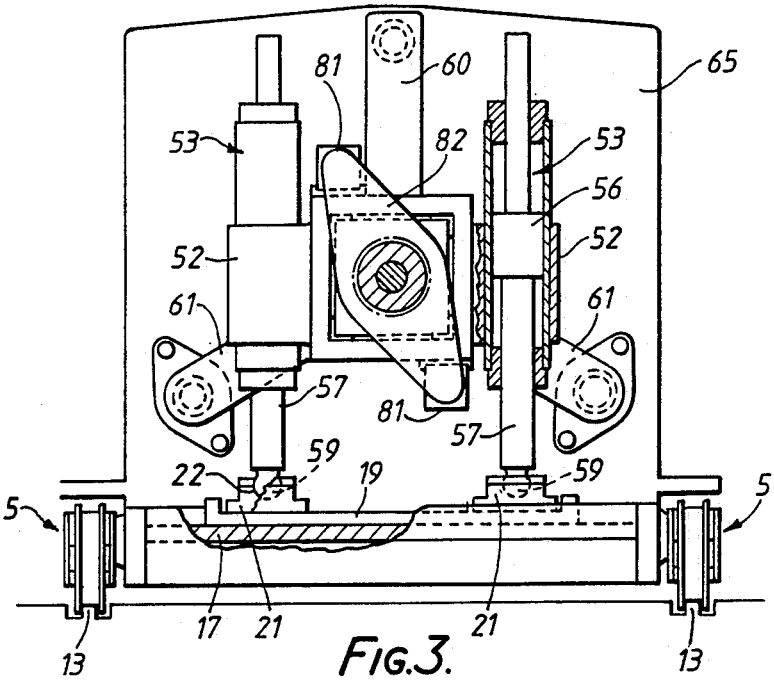
FIG. 3 is an end elevation, partly in section, on the line III—III of FIG. 1.
Figure 4:
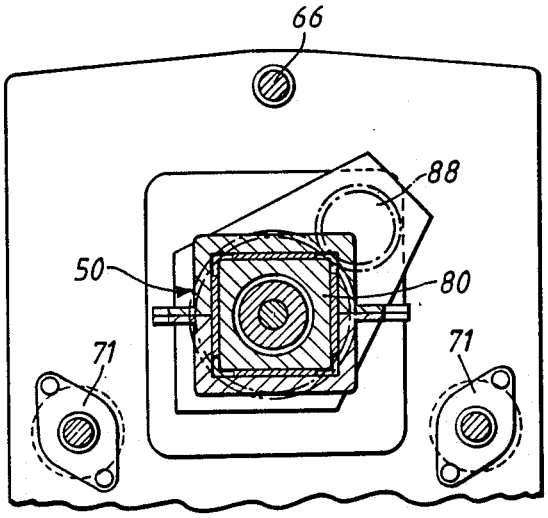
FIG. 4 is a sectional end elevation on the line IV—IV of FIG. 1.
Figure 5:
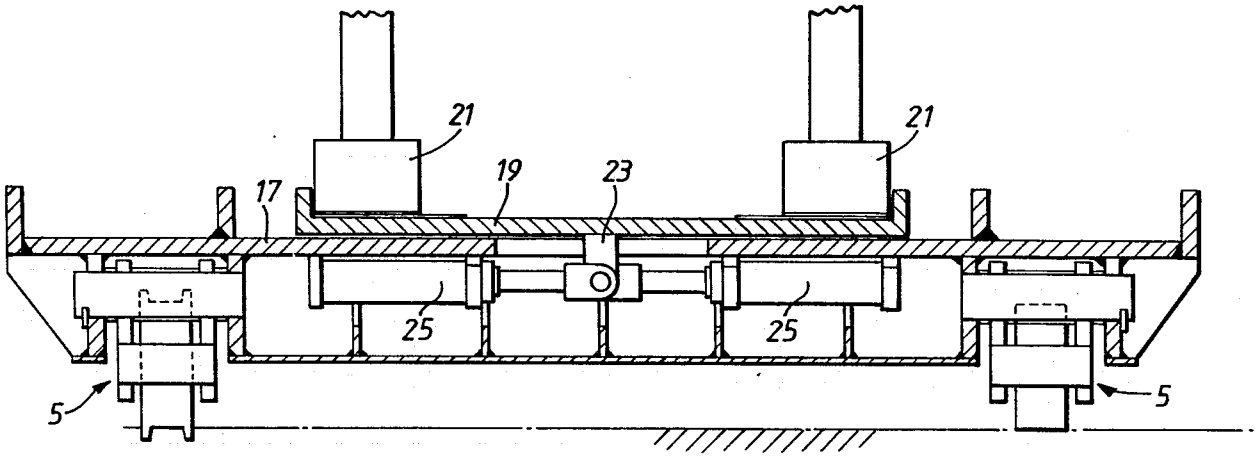
FIG. 5 is a section on the line V—V of FIG. 2.

The peel assembly is conveniently of the form described in our co-pending application Ser. No. 269,738, filed Nov. 2, 1988, now U.S. Pat. No. 4,878,373. The assembly has a structure including an outer housing 50 which has a pair of laterally extending wings 52 at its front end. Each wing supports a piston-cylinder device 53. As shown in FIG. 3, the piston cylinder devices comprise a cylinder secured to the corresponding wing 52 and a piston 56 displaceable in the cylinder. Each piston has a downwardly extending piston rod 57 which is terminated at its lower end by a spherical bearing unit 59. The spherical bearings units of the piston rods engage with the two part-spherical surfaces 22 on the shoes 21. The outer housing 50 also has a vertical projection 60 extending upwardly from the housing and a pair of projections 61 projecting outwardly and downwardly from the outer housing at an angle of approximately 45°.

The peel assembly also includes an inner housing 80 of rectangular cross-section (see FIG. 4) which is free to slide in the direction of its length relative to the outer housing 50. A pair of piston-cylinder devices 81 are mounted on the outside of the outer housing 50 and their piston rods are connected to a crosshead 82 which is connected to the inner housing 80. By operating the piston-cylinder devices 81, the inner housing can be displaced in the direction of its length relative to the fixed outer housing 50. The inner housing rotatably supports a peel shaft 84 which has an enlarged head 85 at its forward end and at least one pair of jaws 86 pivotally mounted on the head 85. The shaft 84 is rotatable about its longitudinal axis by way of a drive motor 88 which is connected to the shaft 84 by way of a gear and pinion mechanism 90.

On the rear structure 9 of the carriage there is a rigid support in the form of an upstanding wall 65 and, between this wall and the projection 60 on the housing structure of the peel asseembly, there is an elongate link 66 connected at its end through couplings 67 to the wall 65 and to the projection 60. Each of the projections 61 has a separate elongate link 69 connected to it through a coupling 70 and the opposite end of each link 69 is connected through a coupling 70 to a crosshead 71. Each crosshead is displaceable towards and away from the wall 65 by means of a piston-cylinder device 72 mounted behind the wall 65 and connected to the crosshead 71. Thus, by operating the piston-cylinder device, the crosshead can be drawn towards and away from the wall 65, thus displacing the link 69 in the direction of its length.

Figure 2:
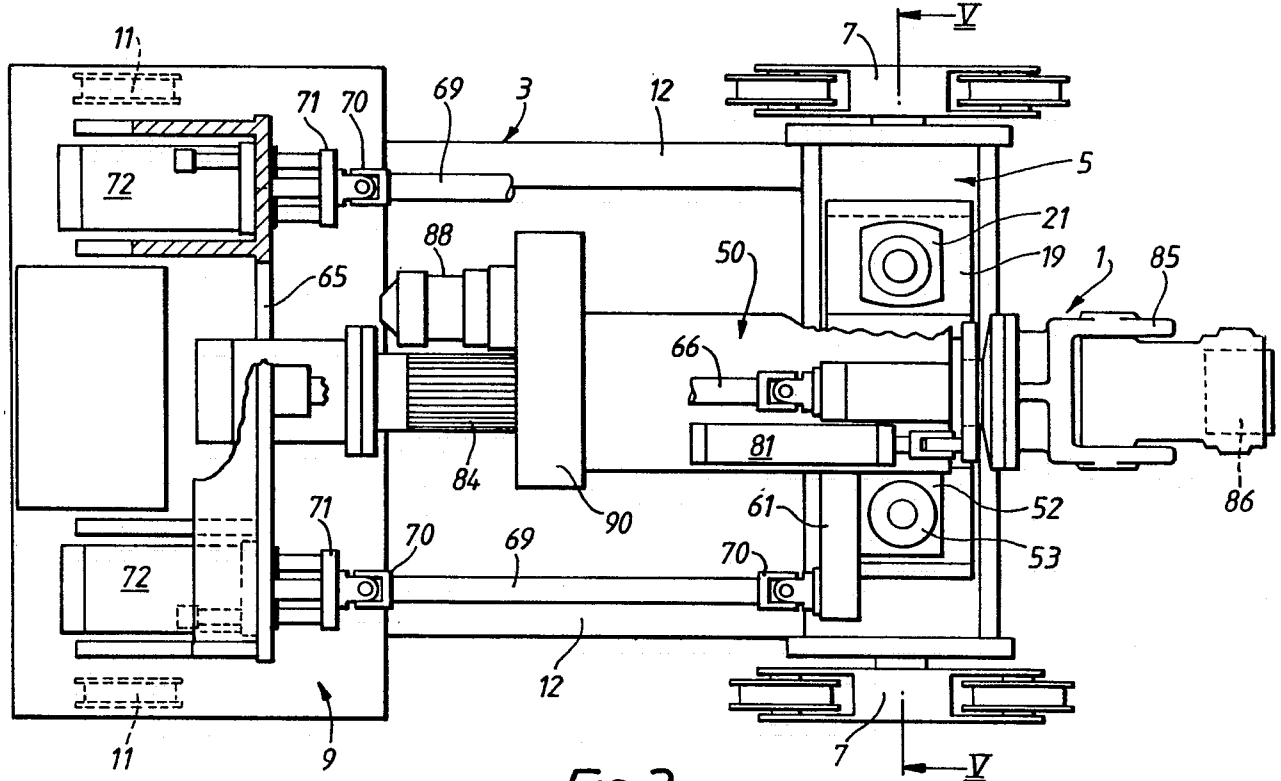
FIG. 2 is a plan view, with part cut away, of the manupualtor shown in FIG. 1.

From the position shown in FIGS. 1 and 2, with the longitudinal axis of the peel assembly substantially horizontal and extending in the direction of movement of the carriage, various movements can be obtained in the manner now to be described.

The peel shaft 84 can be rotated about its longitudinal axis by way of the drive motor 88 and the gear mechanism 90.

The shaft 84 and the jaws 86 can be moved backwards and forwards in the direction of the length of the shaft 84 by means of the piston-cylinder devices 81 and the crosshead 82.

Figure 8:
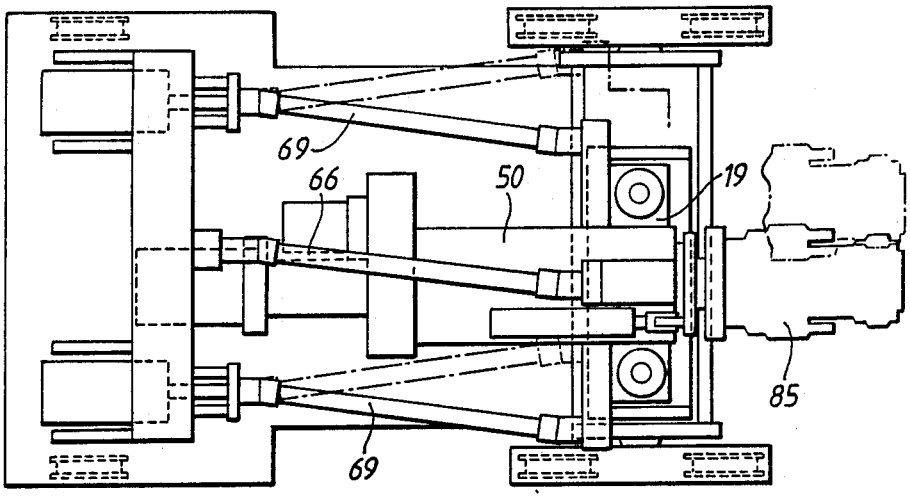
FIGS. 8 and 9 are plan views showing various positions of the peel with respect to the carriage.

By operating the piston-cylinder devices 25, the slide 19 can be displaced transverse of the carriage to displace the peel assembly laterally towards and away from the side walls of the carriage. The extreme displaced positions are as shown in FIG. 8.

Figure 6:
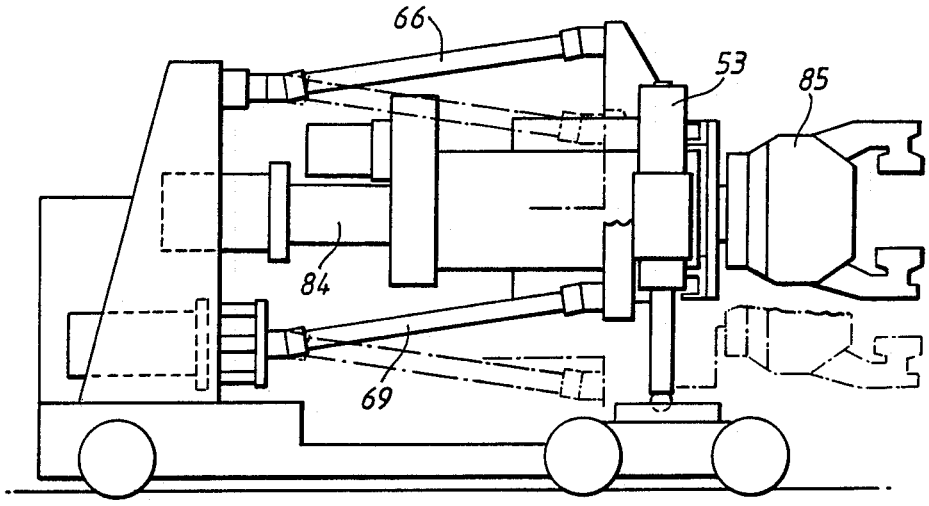
FIGS. 6 and 7 are side elevations showing various positions of the peel with respect to the carriage.

The peel assembly can be hoisted up and down with respect to the carriage while keeping the axis of the shaft 84 substantially horizontal by operating the two piston-cylinder devices 53. The extreme displaced positions of the peel assembly are as shown in FIG. 6.

Figure 7:
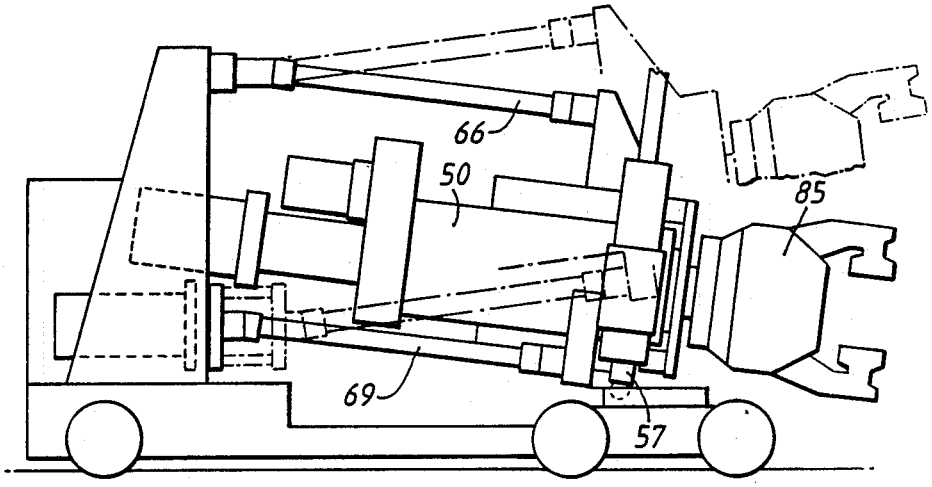

For any hoist position, by backwardly repositioning the links 69 by operating the piston-cylinder devices 72, the peel assembly can be caused to tilt down, i.e. move downwardly at the front end and upwardly at the rear end, with the assembly sliding about the ends of the piston rods 57 on the surfaces on the front structure 5 of the carriage, in the manner shown in full lines in FIG. 7 which shows the maximum forward tilt at minimum hoist. Similarly, by forwardly re-positioning the links 69 by operating the piston-cylinder devices 72, the peel assembly is caused to tilt up, i.e. the front end of the peel assembly can be raised upwardly and the rear end moved downwardly with the assembly pivoting about the surfaces 23, as shown in broken lines in FIG. 7 which shows the maximum backwards tilt at maximum hoist.

Figure 9:
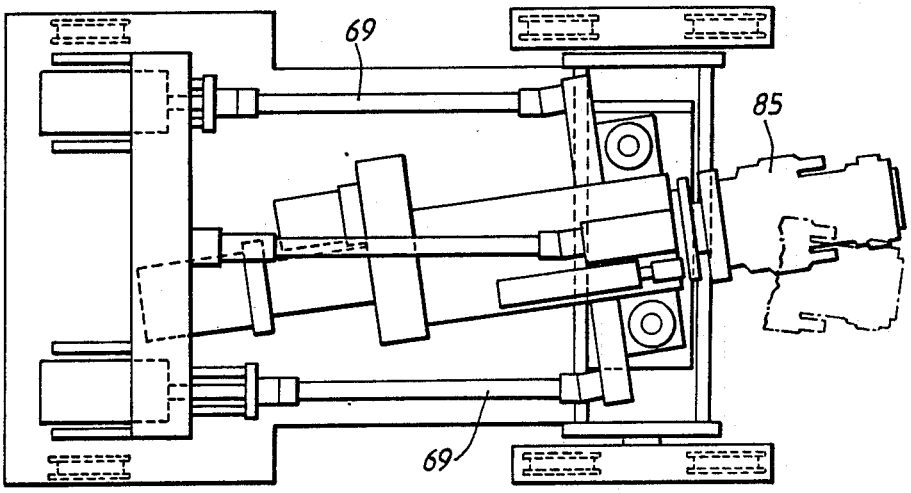

Furthermore, by forwardly extending the position of one of the links 69 while retracting the position of the other link 69, the peel assembly can be caused to pivot about the front structure of the carriage, in the manner shown in FIG. 9. To allow the displacement of the peel assembly, the shoes 21 are displaced in the slide plate 19.

Figure 10:
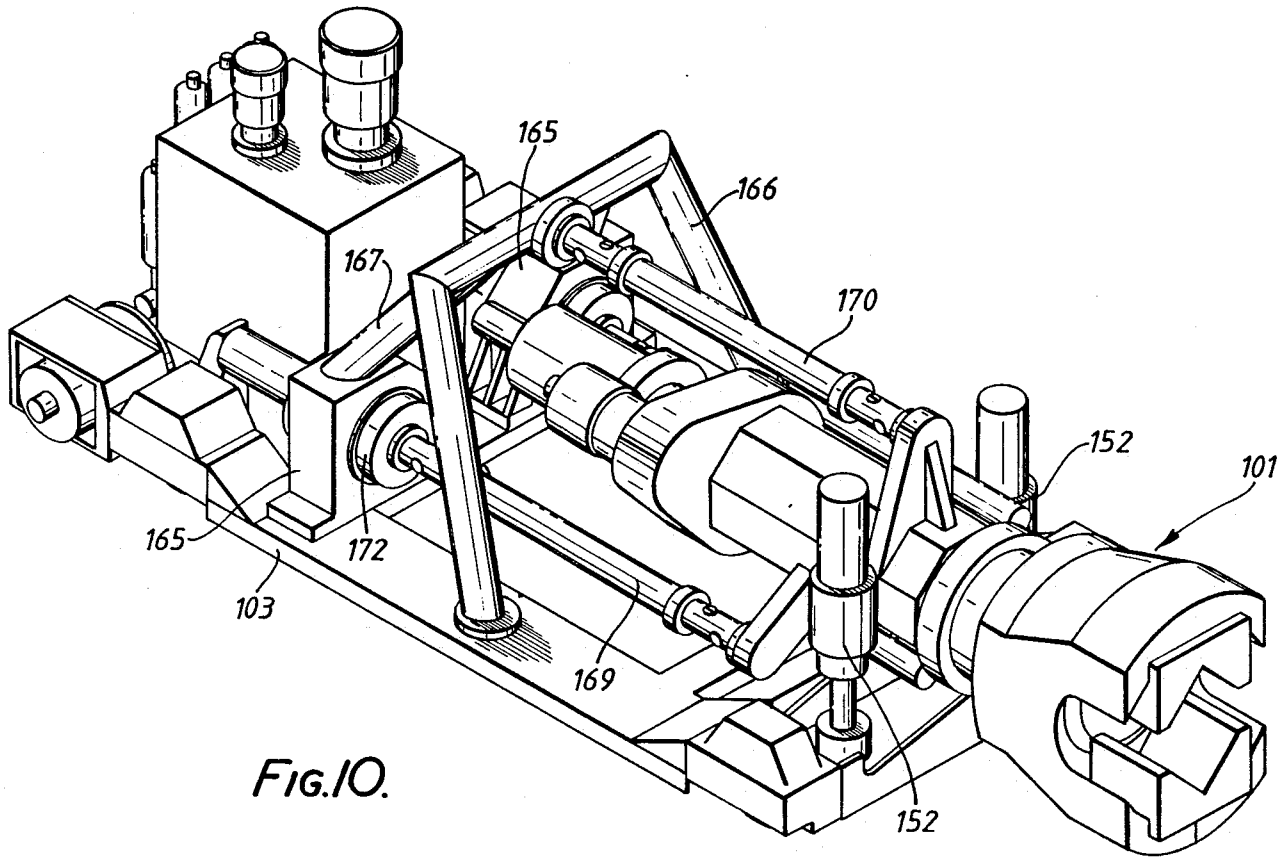
FIG. 10 is a perspective view of a manipulator according to an alternative embodiment of the invention.

FIG. 10 is a perspective view of an alternative form of manipulator from those shown in FIGS. 1 to 9, although the basic features are the same. The peel assembly 101 is supported on the wheeled carriage 103 adjacent its front and by piston-cylinder devices 152 which enable the assembly to be raised and lowered relative to the carriage.

Towards the rear end of the carriage, a rigid support takes the form of two upstanding walls 165 arranged side-by-side on the carriage. A tubular steel hoop-shaped frame 166 is anchored at each end to the carriage and tubular steel support struts 167 are secured to the frame 166 and to repsective upstanding walls 165.

Each wall accommodates a piston-cylinder device 172, the piston of which is connected through a pivotal coupling to one end of a link 169, the other end of each link being pivotally coupled to the housing of the peel assembly. A third link 170 is connected through a pivotal coupling to the hoop-shaped frame 166 and to the housing of the peel assembly.

The various movements of the peel are obtained in the manner described above with reference to FIGS. 1 to 9.

A manipulator in accordance with the present invention is versatile in that the peel assembly is readily movable in a number of directions relative to the wheeled carriage. The weight of a manipulator according to the invention for manipulating an ingot of a particular weight is considerably less than that of known manipulators for manipulating ingots of the same weight because of the manner in which the peel assembly is supported on the carriage.

We claim:

1. A manipulator for a metal ingot comprising a peel assembly and a wheeled carriage, said peel assembly comprising an elongate shaft having at least two cooperating jaws at one end thereof, said shaft being mounted for rotation about its longitudinal axis in a housing structure; said peel assembly being supported on the carriage with the shaft extending in the direction of movement of the carriage by at least one fluid operable piston-cylinder device having one part thereof connected to the housing structure and the other part thereof engaging the carriage adjacent a first end thereof such that the housing structure can be raised and lowered by operation of the piston-cylinder device; said carriage having a rigid support means spaced from said first end; first and second elongate links positioned one on each side of the vertical plane containing the longitudinal axis of the shaft, said links being pivotally secured at their ends to the rigid support means and to the housing structure adjacent the piston-cylinder device, respectively; means for displacing said links in the direction of their length; and a third link positioned above the longitudinal axis of the shaft and pivotally secured at its ends to the rigid support means and to the housing structure adjacent the piston-cylinder device, respectively.

2. A manipulator as claimed in claim 1, in which there are two piston-cylinder devices, one on each side of the shaft end, each having its cylinder connected to the housing structure and the outer end of its piston engaging the wheeled carriage.

3. A manipulator as claimed in claim 2, in which the outer end of each piston is of part spherical form and engages with a corresponding part-spherical surface on the carriage.

4. A manipulator as claimed in claim 2, in which the outer ends of the pistons engage with a part of the carriage which is displaceable with respect to the remaining part of the carriage in the direction normal to the direction of movement of the wheeled carriage.

5. A manipulator as claimed in claim 1, in which the first and second links are located below the longitudinal axis of the peel on opposite sides of the vertical plane containing the axis of the peel and the third link is located in the vertical plane containing the axis of the peel and above the longitudinal axis of the peel.

6. A manipulator as claimed in claim 5, in which each of said first and second links which is below the longitudinal axis of the peel has one part of a piston-cylinder device connected either directly or indirectly to it with the other part of the device connected to .

7. A manipulator as claimed in claim 1, in which the rigid support means includes a tubular metal structure.

* * * * *